US008104610B2

(12) United States Patent
Lee et al.

(10) Patent No.: US 8,104,610 B2
(45) Date of Patent: Jan. 31, 2012

(54) METHOD AND STRUCTURE FOR MIXING DIFFERENT MATERIALS

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 1338 days.

(21) Appl. No.: 10/584,094

(22) PCT Filed: Nov. 5, 2004

(86) PCT No.: PCT/KR2004/002842

§ 371 (c)(1),
(2), (4) Date: Jun. 22, 2006

(87) PCT Pub. No.: WO2005/044683

PCT Pub. Date: May 19, 2005

(65) Prior Publication Data

US 2007/0029345 A1 Feb. 8, 2007

(30) Foreign Application Priority Data

| | | |
|---|---|---|
| Nov. 5, 2003 | (KR) | 10-2003-0080378 |
| Jan. 15, 2004 | (KR) | 10-2004-0004030 |
| Jan. 19, 2004 | (KR) | 10-2004-0004883 |
| Jan. 19, 2004 | (KR) | 10-2004-0004884 |
| Apr. 2, 2004 | (KR) | 10-2004-0023921 |
| Apr. 2, 2004 | (KR) | 10-2004-0023923 |
| Apr. 17, 2004 | (KR) | 10-2004-0027306 |
| Apr. 21, 2004 | (KR) | 10-2004-0028841 |
| Jul. 19, 2004 | (KR) | 10-2004-0060997 |
| Aug. 13, 2004 | (KR) | 10-2004-0064912 |
| Sep. 13, 2004 | (KR) | 10-2004-0074774 |
| Sep. 24, 2004 | (KR) | 10-2004-0079737 |
| Oct. 25, 2004 | (KR) | 10-2004-0086929 |
| Oct. 25, 2004 | (KR) | 10-2004-0086930 |
| Oct. 25, 2004 | (KR) | 10-2004-0086931 |

(51) Int. Cl.
*B65D 25/08* (2006.01)

(52) U.S. Cl. ..... 206/219; 215/DIG. 8

(58) Field of Classification Search ..... 206/219, 206/220, 221; 222/524.1, 525; 215/DIG. 8
See application file for complete search history.

(56) References Cited

U.S. PATENT DOCUMENTS

| | | | | |
|---|---|---|---|---|
| 4,102,451 | A | 7/1978 | Clarke et al. | 206/219 |
| 5,794,802 | A * | 8/1998 | Caola | 215/11.1 |
| 5,944,175 | A * | 8/1999 | Albisetti | 206/221 |
| 6,170,654 | B1 * | 1/2001 | Gartner et al. | 206/219 |
| 6,293,395 | B1 * | 9/2001 | Hof | 206/219 |
| 6,921,087 | B2 * | 7/2005 | Takahashi et al. | 277/628 |
| 7,261,226 | B2 * | 8/2007 | Adams et al. | 222/521 |
| 2002/0053524 | A1 * | 5/2002 | Alticosalian | 206/219 |
| 2003/0017236 | A1 * | 1/2003 | Makita et al. | 426/115 |

FOREIGN PATENT DOCUMENTS

| | | |
|---|---|---|
| JP | 2000-062788 | 2/2000 |
| JP | 2000-072185 | 3/2000 |
| KR | 20-0304877 | 2/2003 |
| WO | WO 97/21605 | 6/1997 |

* cited by examiner

*Primary Examiner* — Jacob K Ackun
(74) *Attorney, Agent, or Firm* — Westman, Champlin & Kelly, P.A.

(57) ABSTRACT

A structure for mixing different materials includes a main body having a lip portion with an upper opening portion, the main body coupled to an opening of a container containing a first material; a spouting guide member movably inserted in the lip portion by a predetermined distance; a cap ascending and descending together with the spouting guide member, the cap being coupled to the main body; and a seal closer separately formed on a lower portion of the spouting guide member.

4 Claims, 18 Drawing Sheets

【FIG 1】
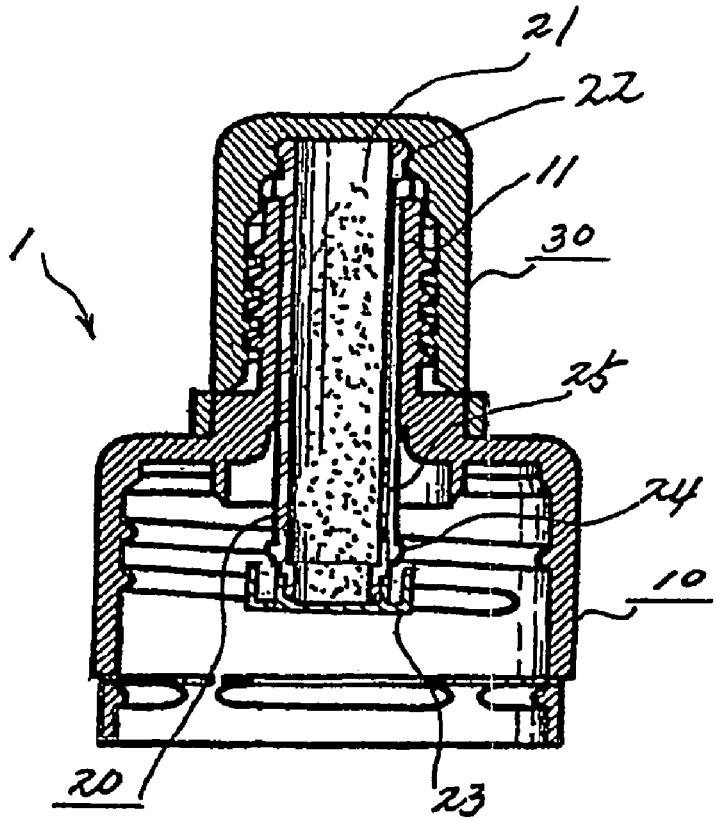

【FIG 2】
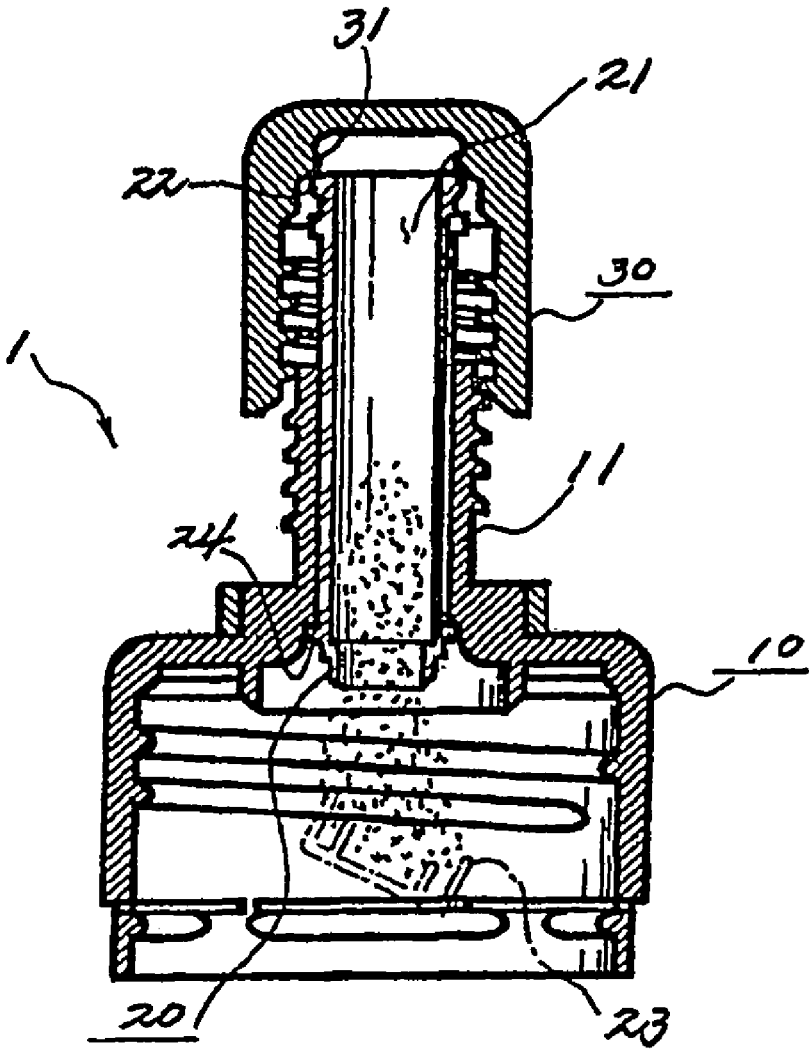

【FIG 3】
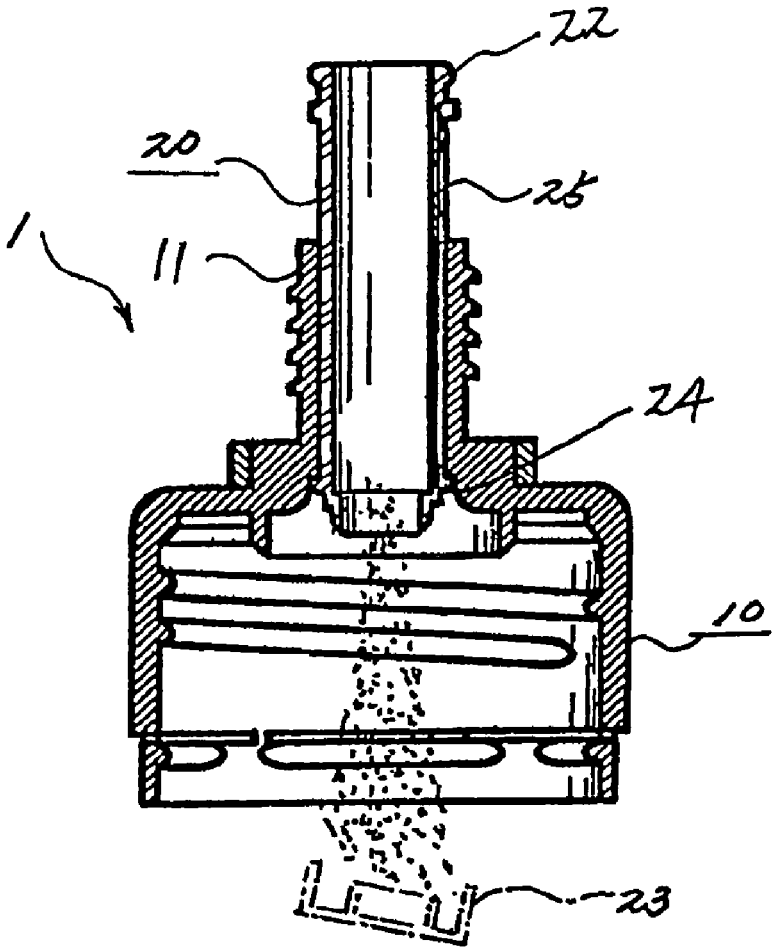

【FIG 4】
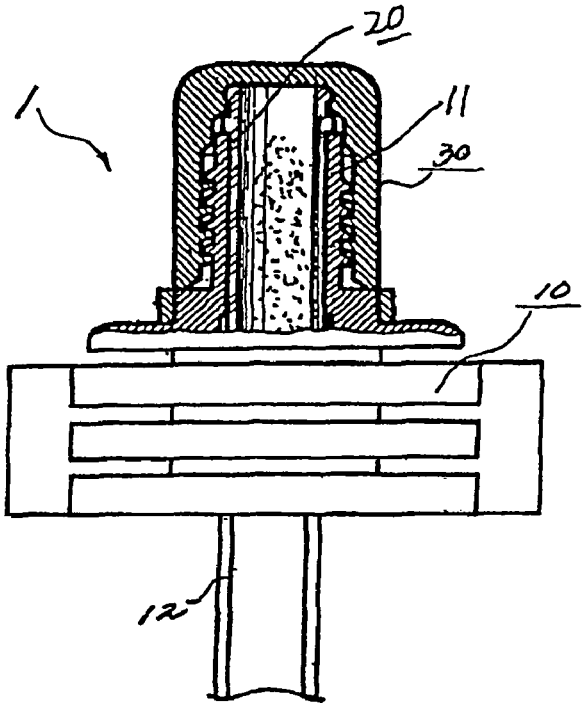
【FIG 5】
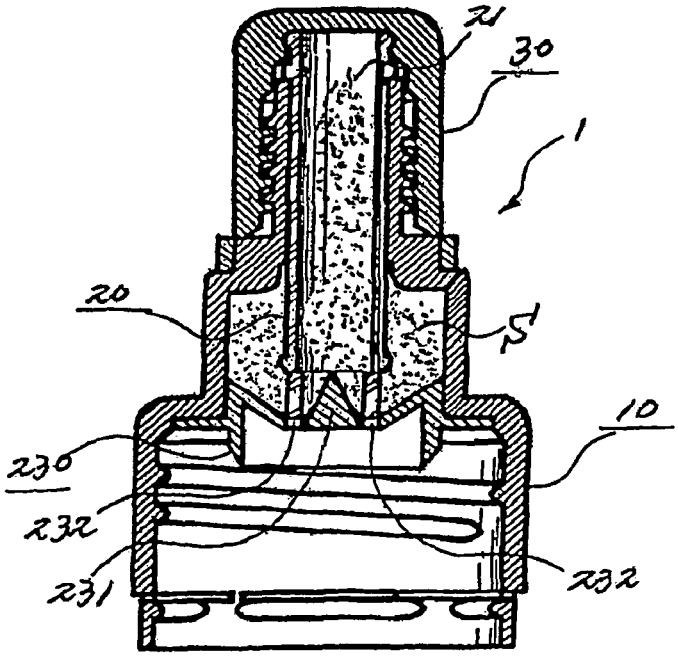

【FIG 6】
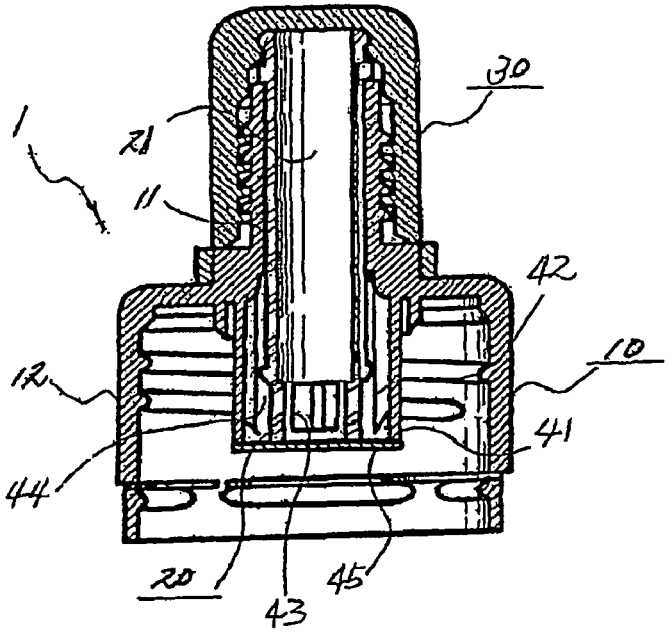
【FIG 7】
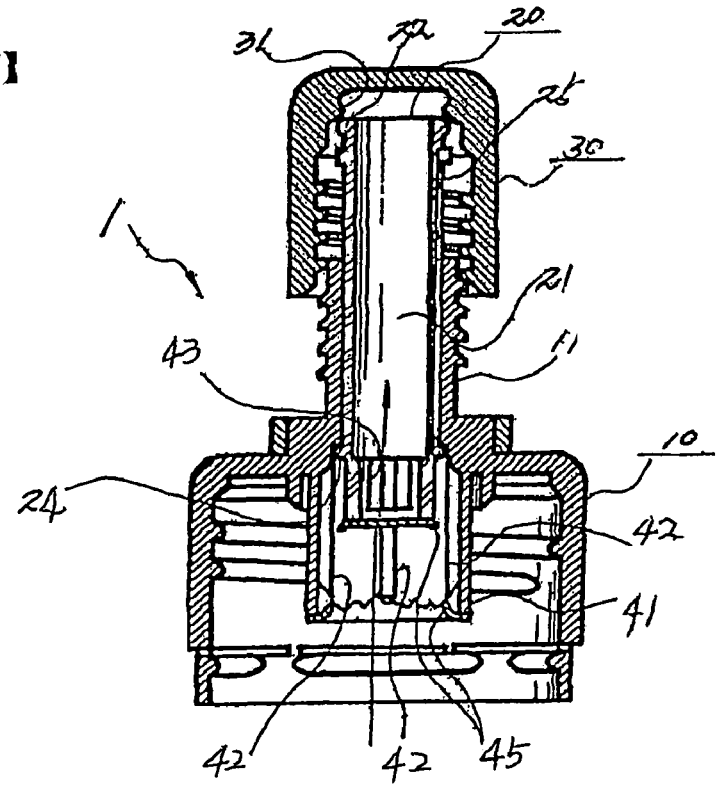

【FIG. 8】
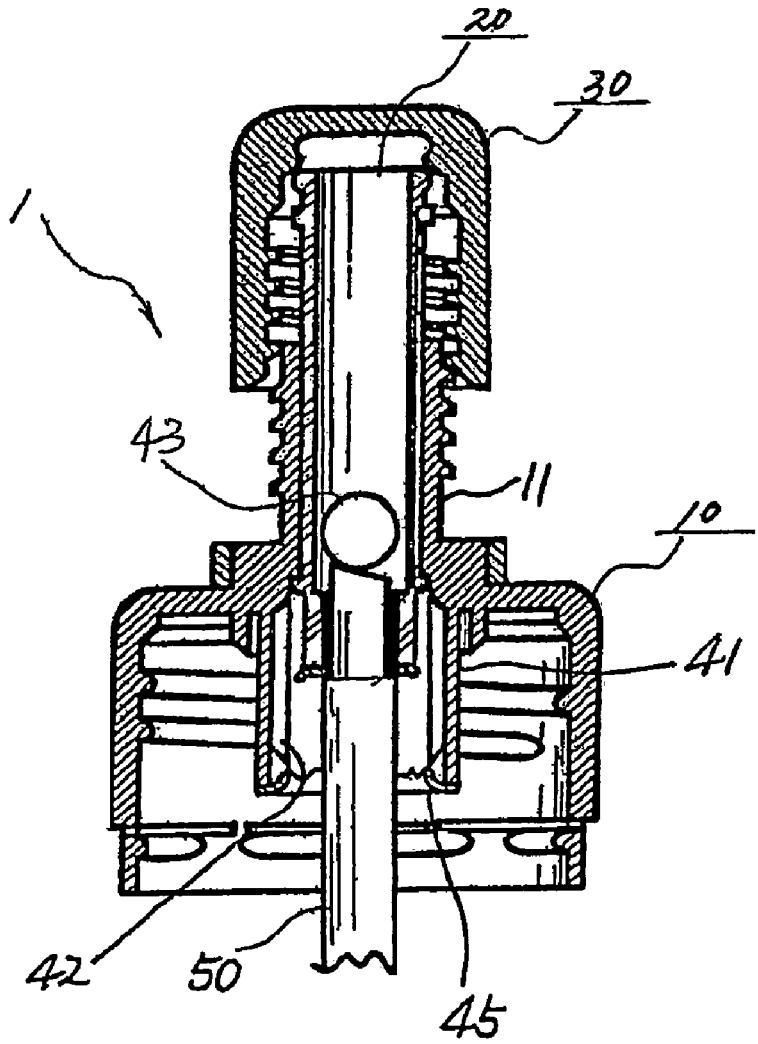

[FIG 9]
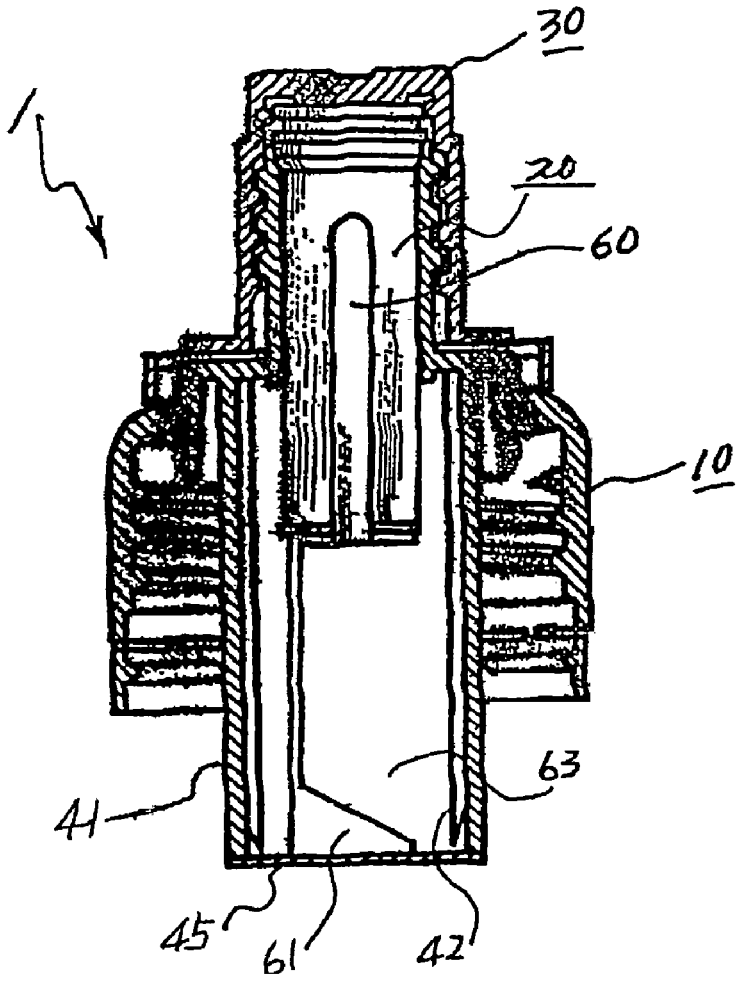

【FIG 10】
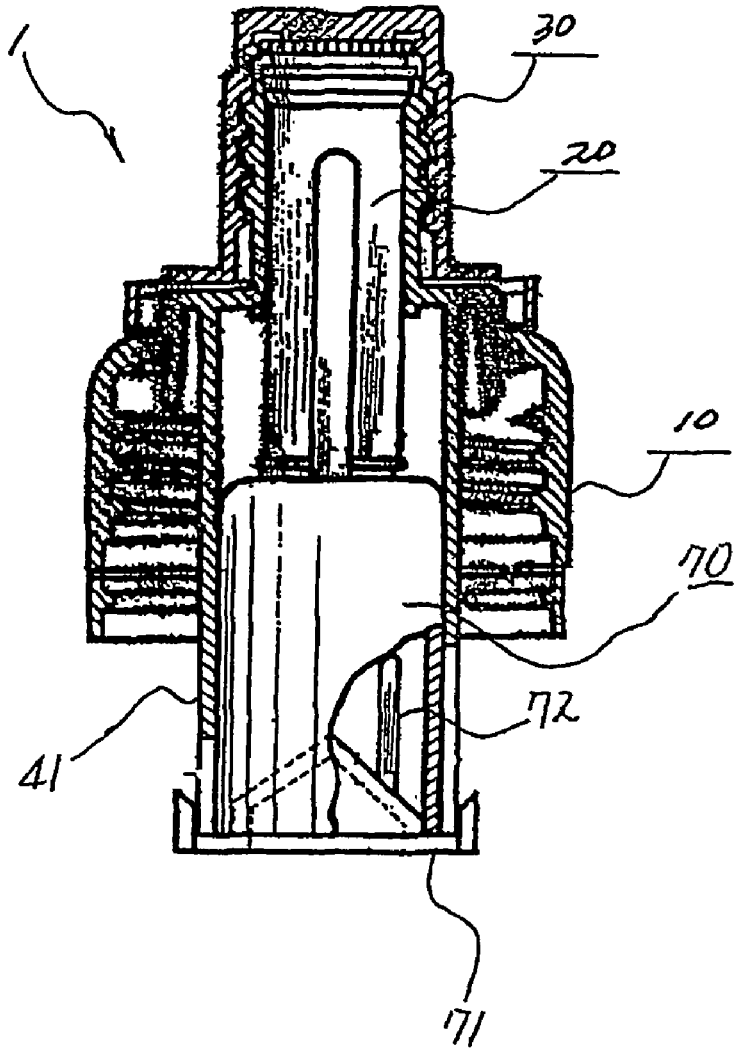

[FIG 11]
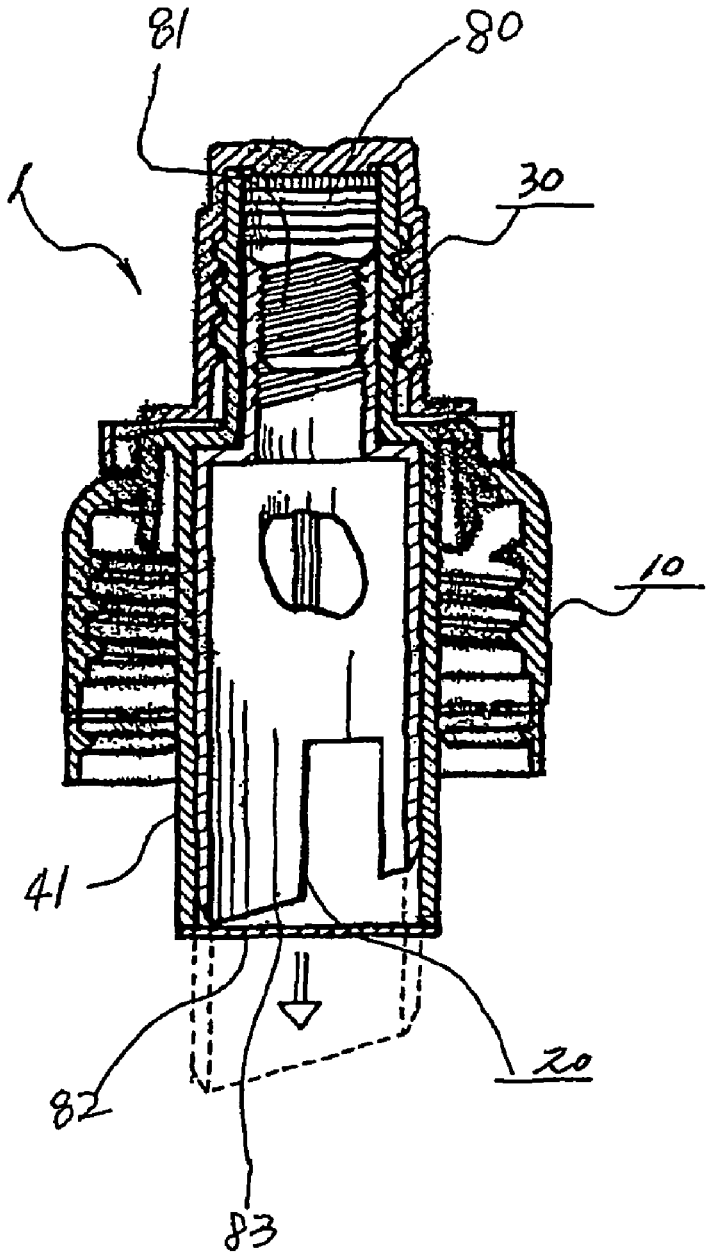

【FIG 12】
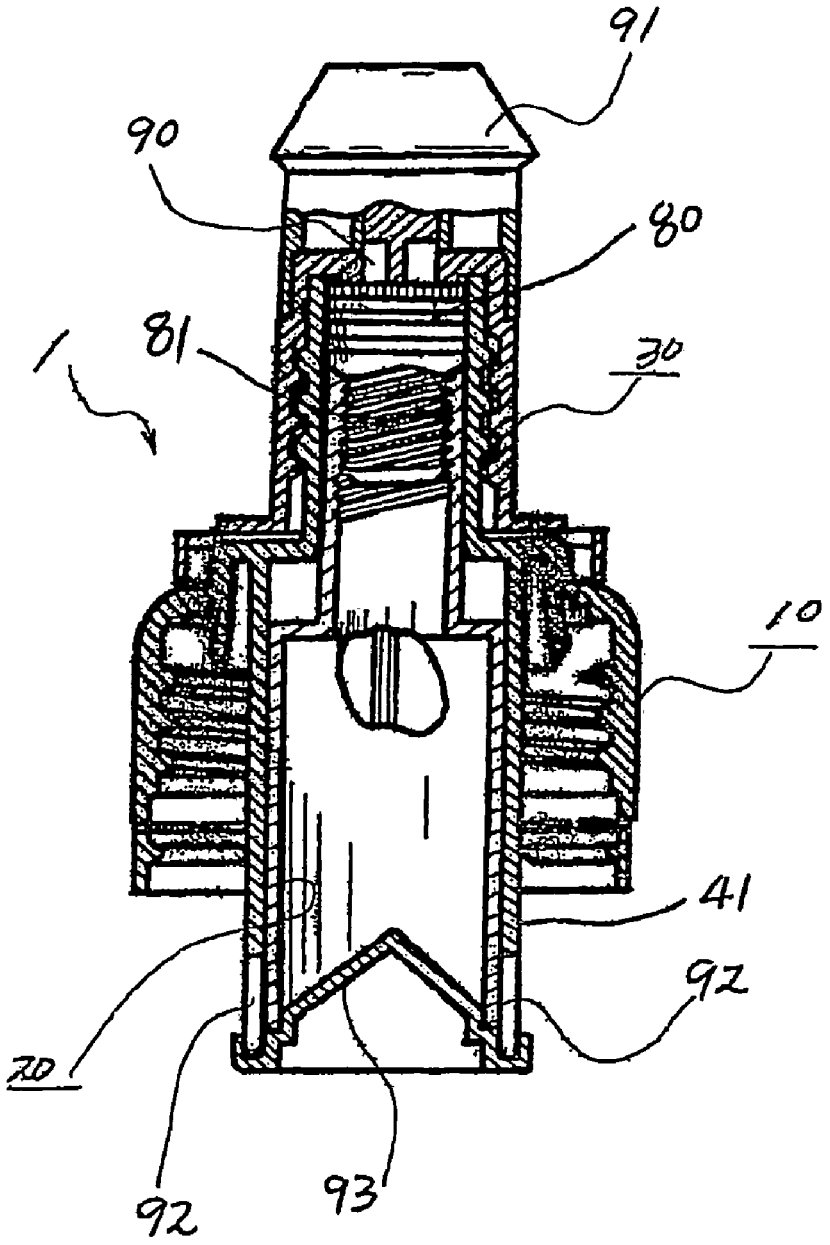

【FIG 13】
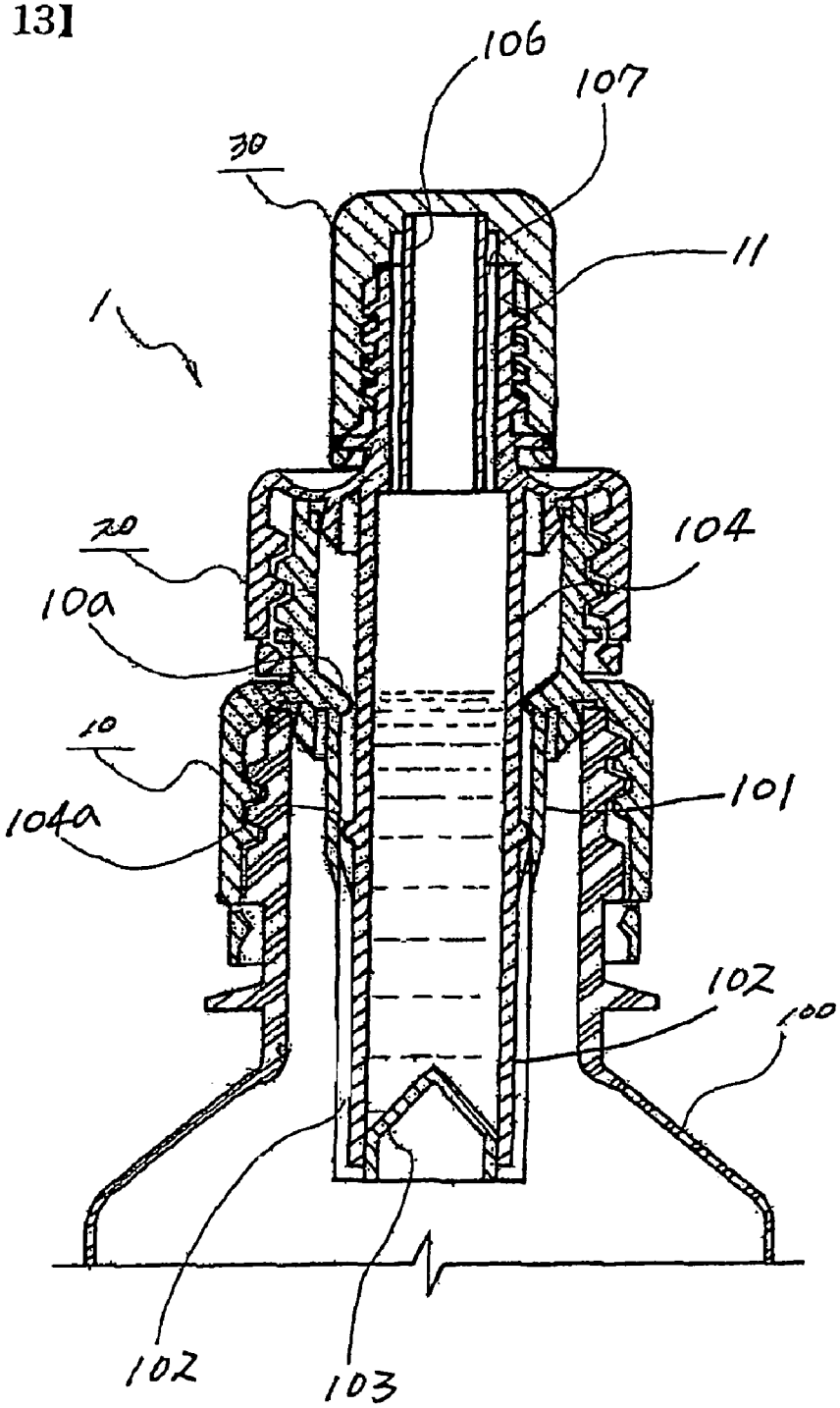

【FIG 14】
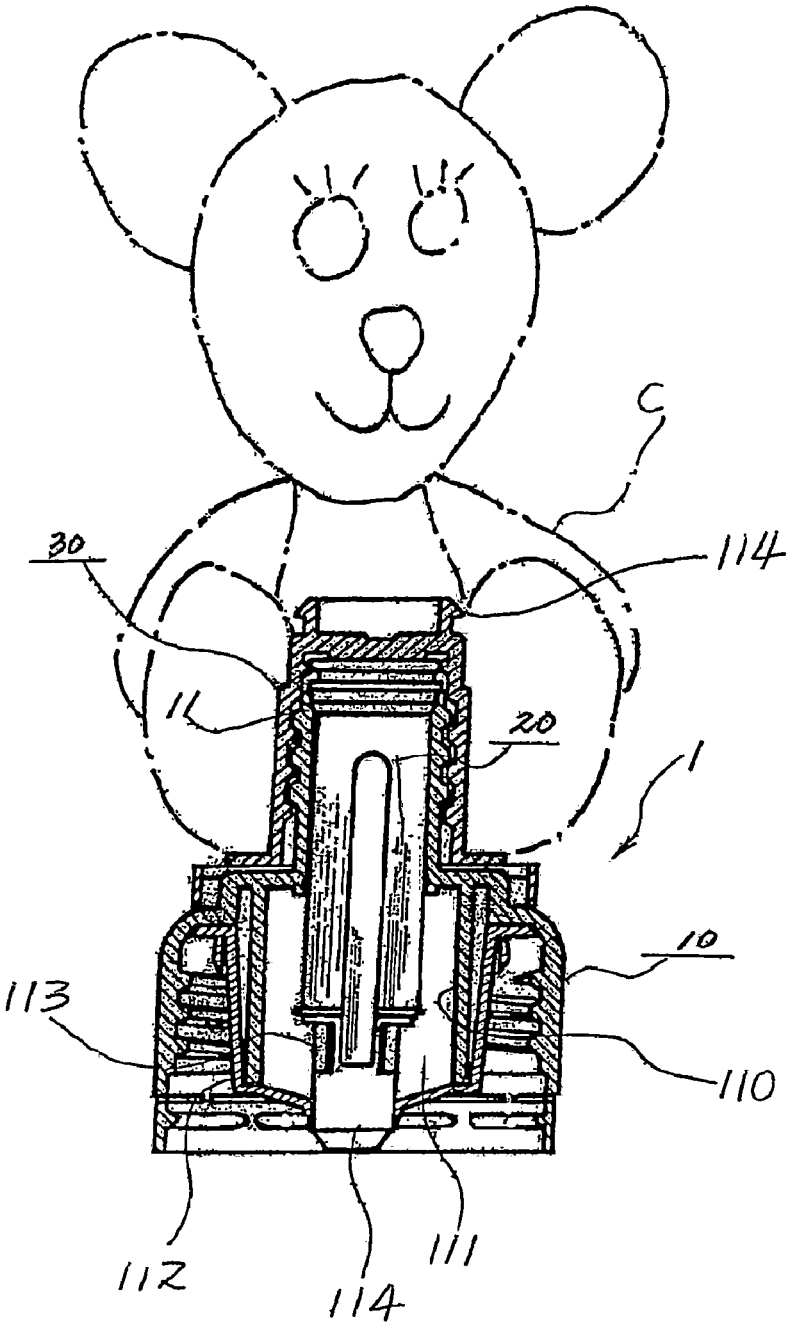

【FIG 15】
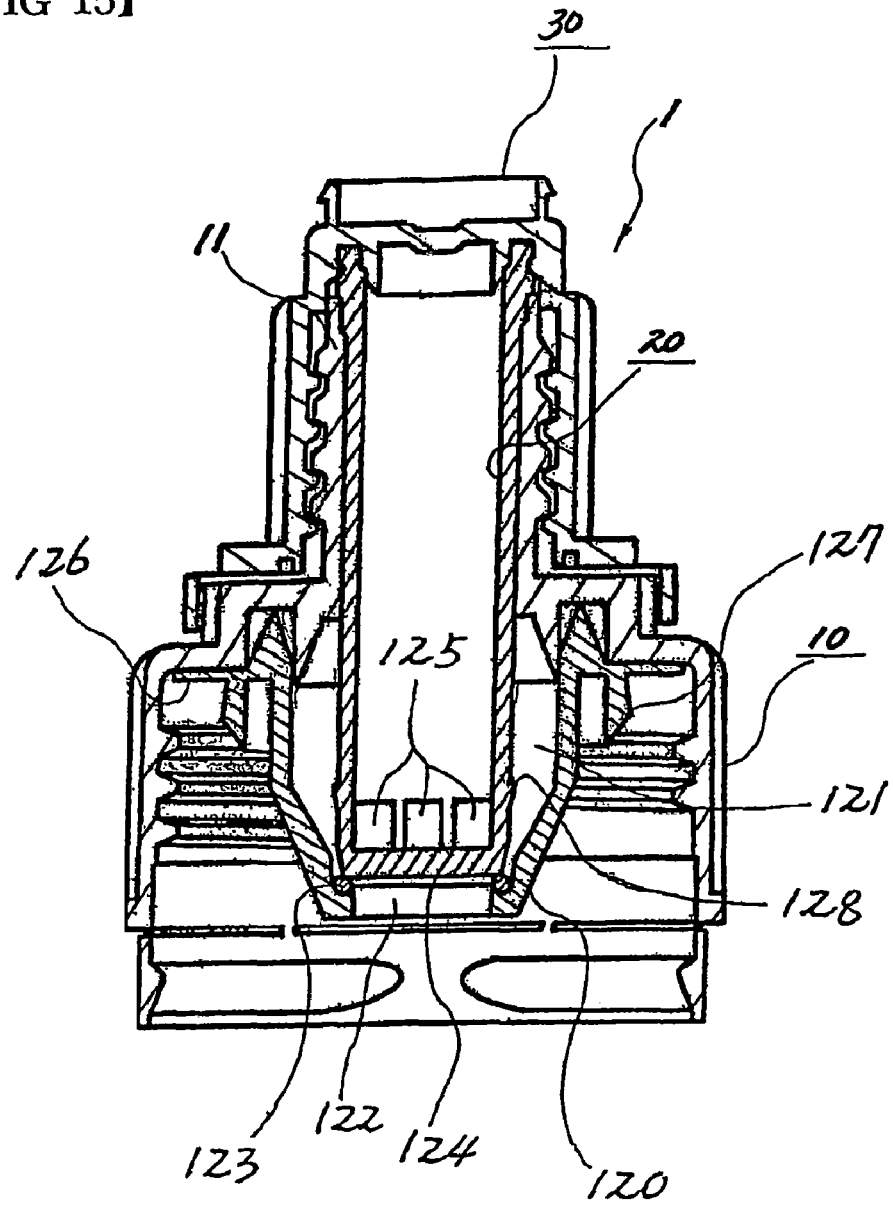

【FIG 16】
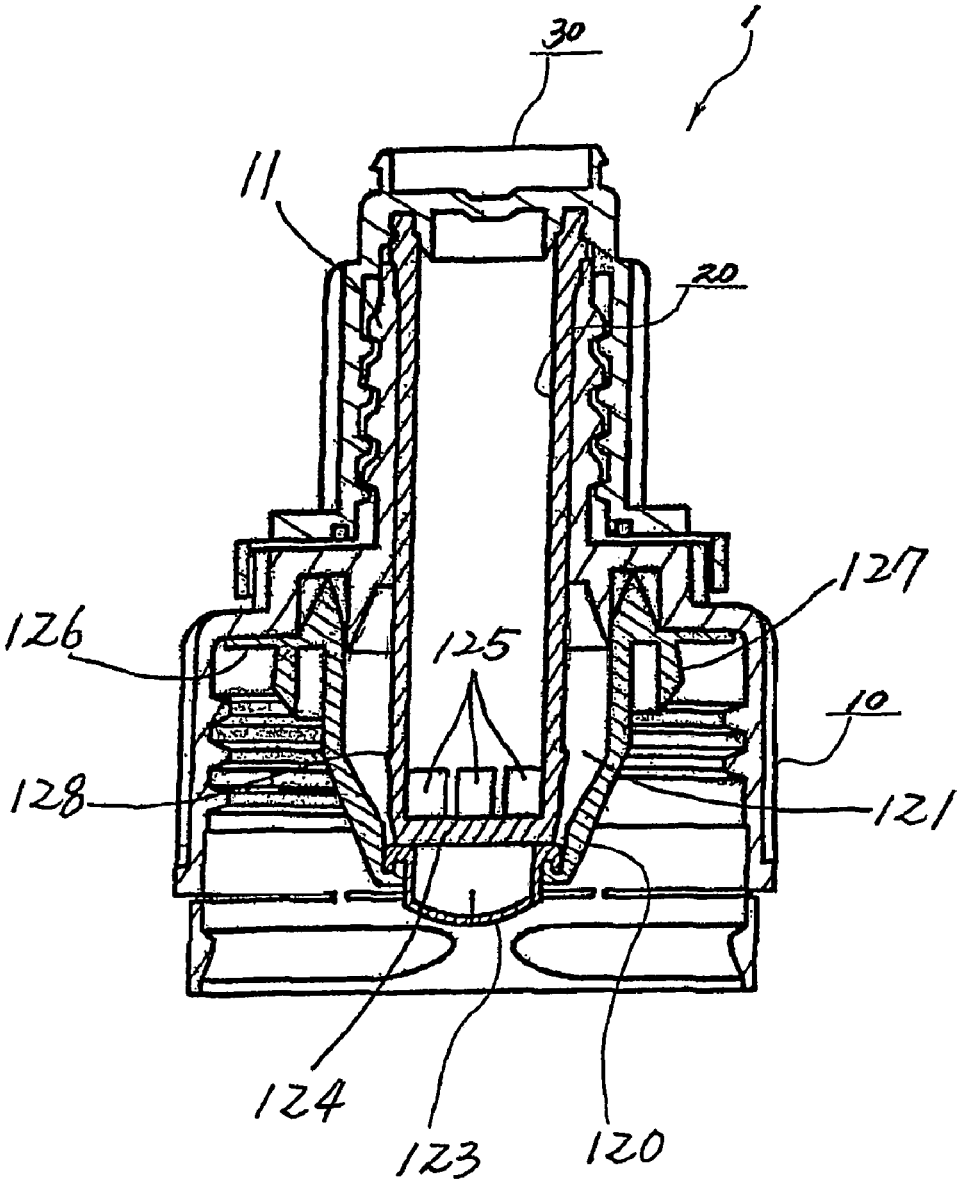

【FIG 17】
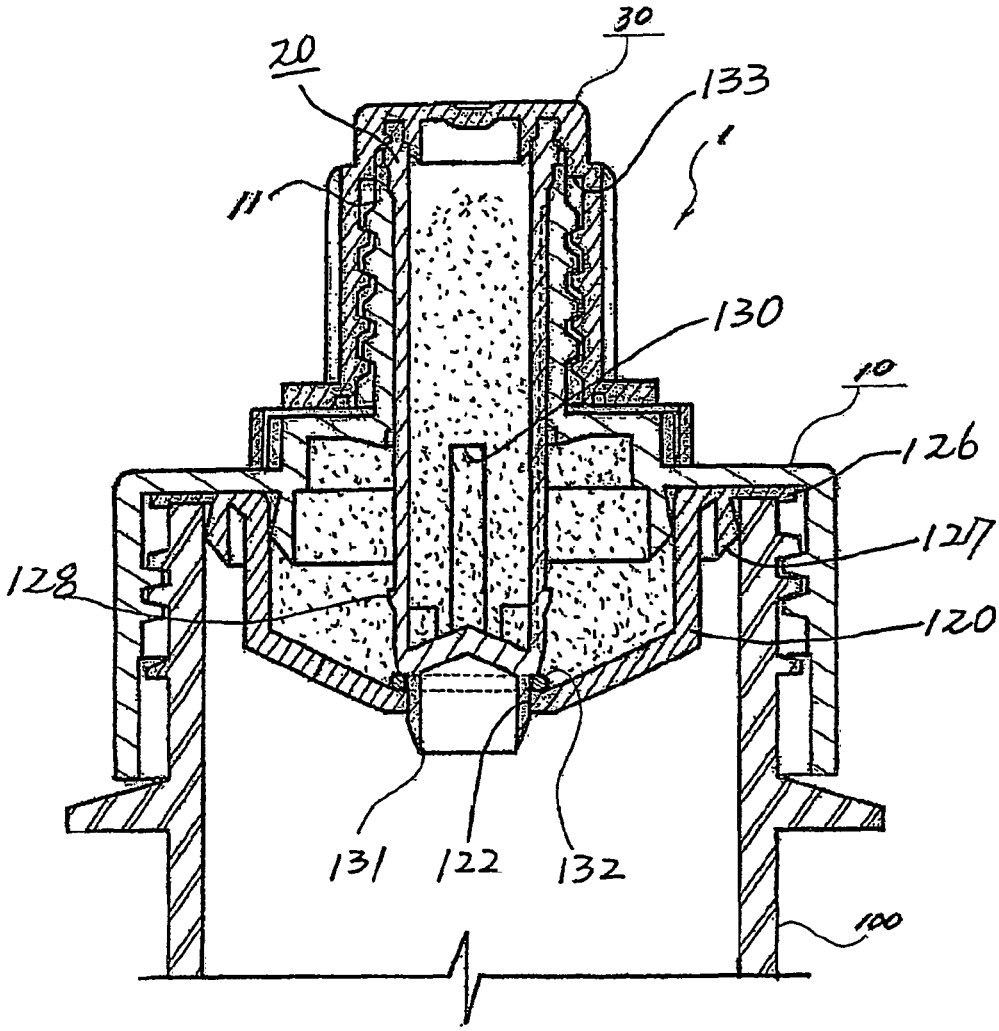
【FIG 18】
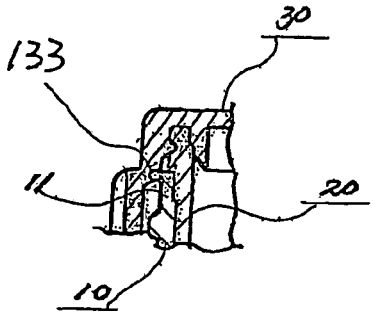

【FIG 19】
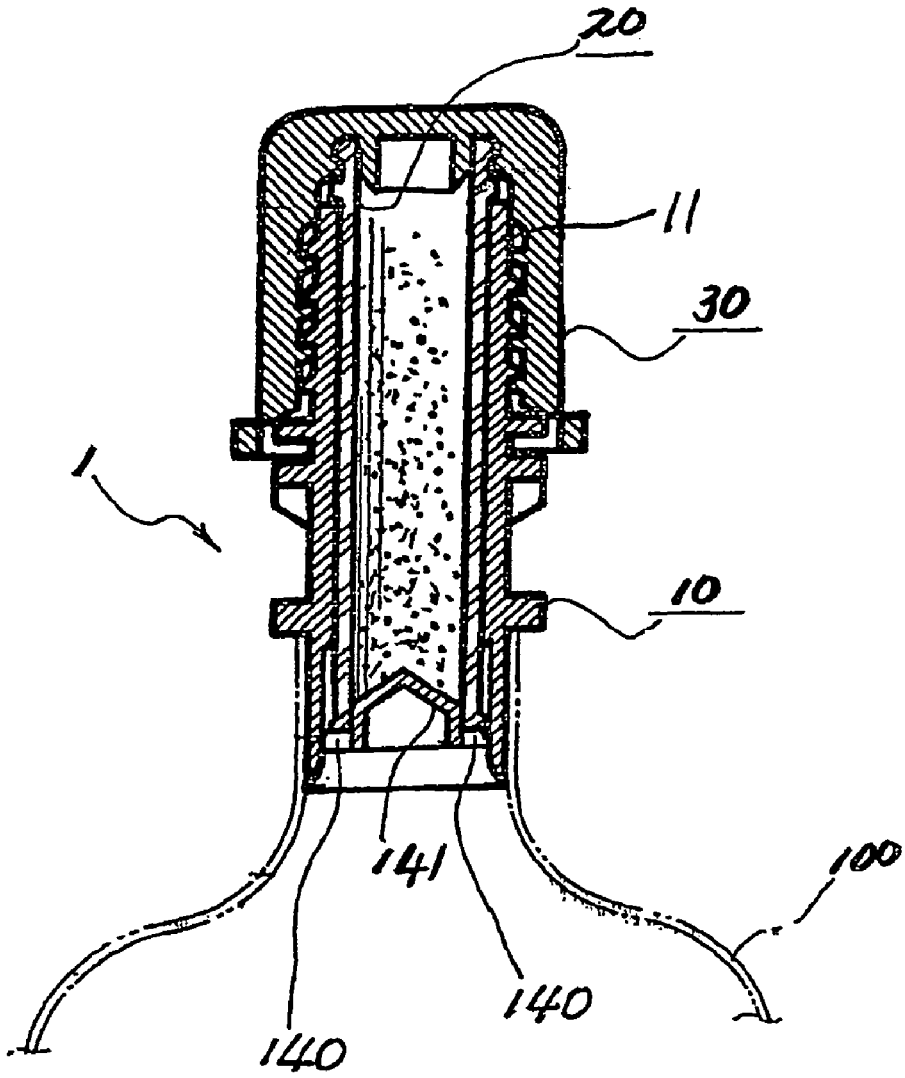

【FIG 20】
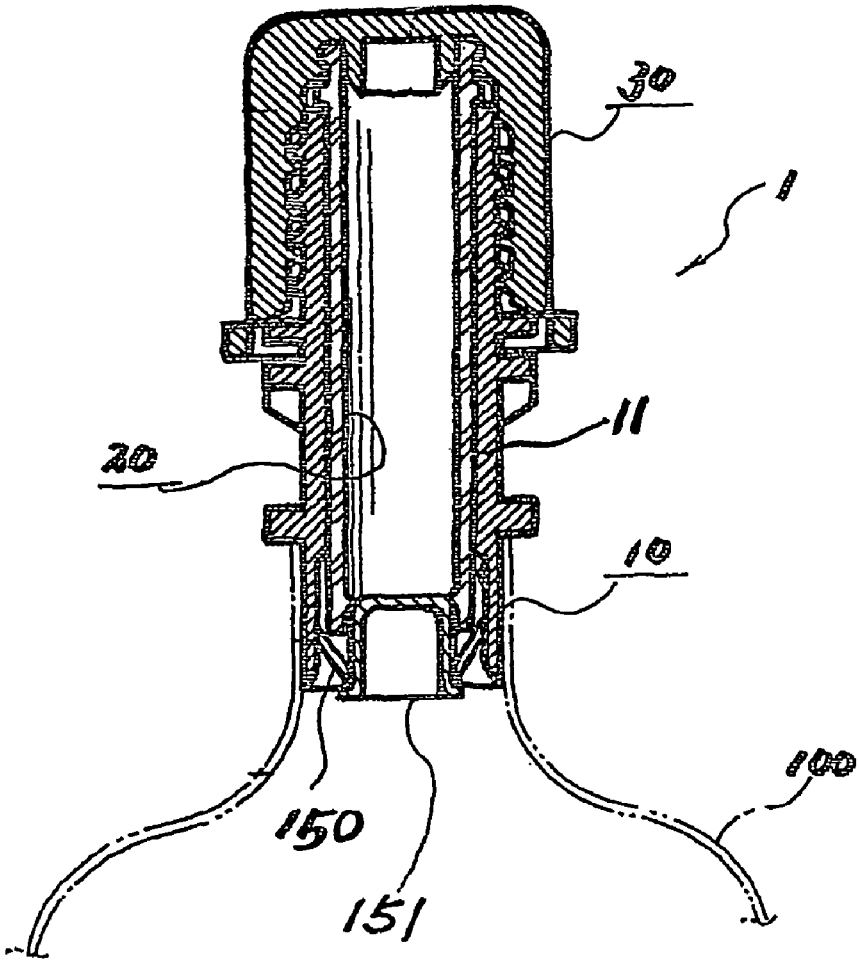

【FIG 21】
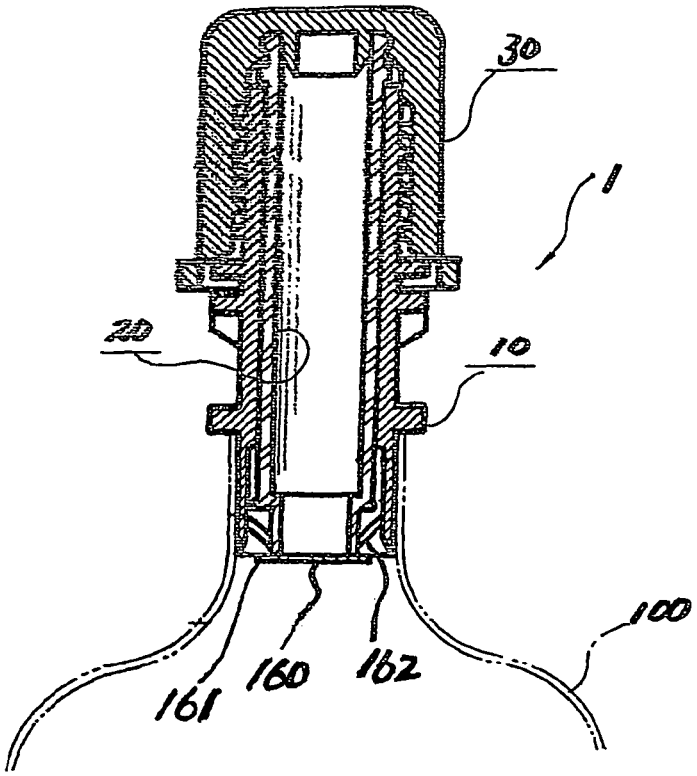
【FIG 22】
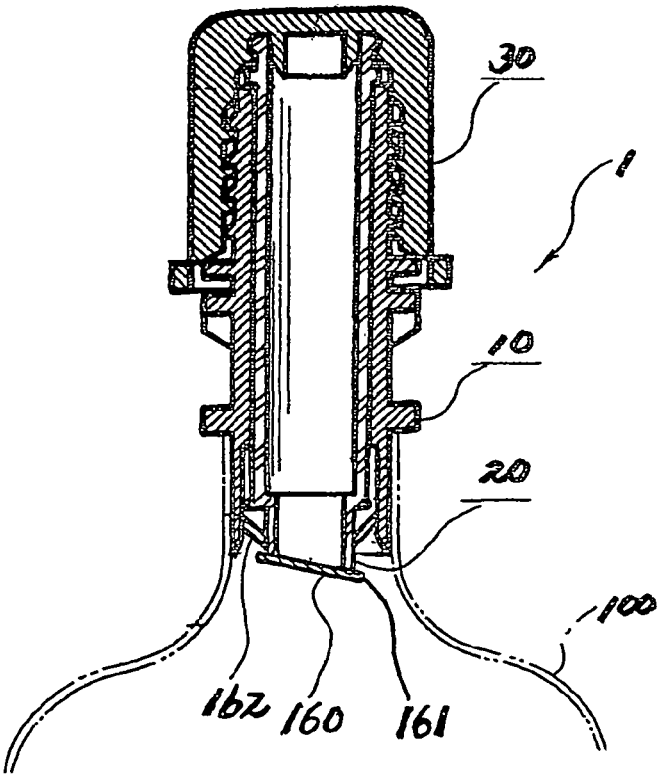

METHOD AND STRUCTURE FOR MIXING DIFFERENT MATERIALS

CROSS-REFERENCE TO RELATED APPLICATION

This Application is a Section 371 National Stage Application of International Application No. PCT/KR2004/002842, filed Nov. 5, 2004 and published as WO 2005/044683 on May 19, 2005, in English, the content of which is hereby incorporated by reference in its entirety.

TECHNICAL FIELD

The present invention relates to a method and structure for mixing different materials, and more particularly, to a method and structure for effectively mixing different materials such as powder and beverage.

BACKGROUND ART

Generally, a special space should be prepared in a beverage container to mix powder with beverage in the beverage container, Korean utility model No. 118,156 discloses a structure for mixing different materials in the container. The structure is designed to mix the different materials in the container by pressing a punching pin. This has a problem in that the punching pin should be removed to drink the contents.

To solve this problem, a structure that is designed to allow contents stored in a special space to be dropt in the container when a cap coupled to the container is opened. This has a problem in that it is difficult to drink the beverage.

SUMMARY OF THE INVENTION

Therefore, the present invention has made in an effort to solve the above-described problems of the conventional art. It is an objective of the present invention to provide a structure and method for mixing different materials, which can improve the drinking convenience by providing a spout portion that is designed to vertically move.

It is another object of the present invention to provide a structure and method for mixing different materials, which is designed to allow contents stored in a special space to be dropt in the container upon opening a cap, thereby providing convenience in use.

It is another object of the present invention to provide a structure and method for mixing different materials, which is designed in a simple structure.

TECHNICAL SOLUTION

To achieve the above objects, the present invention provides a method for mixing a different material, the method comprising the steps of forming a space for storing a different material in a spout assembly coupled or attached on a spouting portion of a container; and allowing the different material to be mixed with content in the container by selectively opening the space by moving a cap of the spout assembly upward.

In another aspect of the present invention, there is provided a structure for mixing different materials, comprising a main body having a lip portion with an upper opening portion, the main body coupled to an opening of a container containing a first material; a spouting guide member movably inserted in the lip portion by a predetermined distance; a cap ascending and descending together with the spouting guide member, the cap being coupled to the main body; and a seal closer separately formed on a lower portion of the spouting guide member.

EFFECT OF THE INVENTION

A structure and method for mixing different materials according to the present invention can improve the drinking convenience by providing a spout portion that is designed to vertically move.

In addition, a structure and method for mixing different materials can allow contents stored in a special space to be dropt in the container upon opening a cap, thereby providing convenience in use.

Furthermore, a structure and method for mixing different materials can be designed in a simple structure.

BRIEF DESCRIPTION OF THE DRAWINGS

FIGS. 1 through 3 are views of a first embodiment of the present invention;

FIG. 4 is a sectional view of a second embodiment of the present invention;

FIG. 5 is a sectional view of a third embodiment of the present invention;

FIGS. 6 and 7 are sectional views of a fourth embodiment of the present invention;

FIG. 8 is a sectional view of a fifth embodiment of the present invention;

FIG. 9 is a sectional view of a sixth embodiment of the present invention;

FIG. 10 is a sectional view of a seventh embodiment of the present invention;

FIG. 11 is a sectional view of an eighth embodiment of the present invention;

FIG. 12 is a sectional view of a ninth embodiment of the present invention;

FIG. 13 is a sectional view of a tenth embodiment of the present invention;

FIG. 14 is a sectional view of an eleventh embodiment of the present invention;

FIGS. 15 and 16 are sectional views of a twelfth third embodiment of the present invention;

FIGS. 17 and 18 are sectional views of a thirteenth embodiment of the present invention;

FIG. 19 is a sectional view of a fourteenth embodiment of the present invention;

FIG. 20 is a sectional view of a fifteenth embodiment of the present invention; and FIGS. 21 and 22 are sectional views of a sixteenth embodiment of the present invention.

BEST MODE FOR CARRYING OUT THE INVENTION

A preferred embodiment of the present invention will be described more in detail hereinafter in conjunction with the accompanying drawings.

FIGS. 1 to 3 are views of a structure for mixing different materials according to a first embodiment of the present invention. A spout assembly 1 is removably coupled on a container such as a beverage container.

The spout assembly 1 includes a main body 10 having a lip portion 11 having an opened upper end and a lower end coupled to the container, a spouting guide member 20 inserted in the lip portion to be vertically slidable 1, and a cap 30 coupled on an upper portion of the main body 10.

The spouting guide member 20 is provide at its inside with a space portion 21 in which a content such as powder is stored and at an upper-outer portion with a circumferential projection 22 that is coupled in a hook portion 31 formed on an inner surface of the cap 30 to move in the vertical direction together with the cap 30, and at a lower-outer portion with a fixing projection 24.

A seal closer 23 is coupled on a lower portion of the spouting guide member 20. The spouting guide member 20 is provided at an outer surface with an air introducing portion 25 in a vertical direction.

The seal closer 23 is removably coupled on the lower portion of the spouting guide member 20. However, the present invention is not limited to this case. That is, the seal closer 23 may be integrally formed on a lower end of the spouting guide member 20.

In the above-described spout assembly 1 formed of synthetic resin, the lip portion 11 is formed on a side of the main body 10 and the spouting guide member 20 having the space portion 21 having a predetermined volume and formed about the lip portion 11 is coupled inside the main body 10. In the space portion 21 of the spouting guide member 20, the content such as powder is stored and the seal closer 23 is tightly coupled on the lower portion of the spouting guide member 20.

As shown in FIG. 2, the seal closer 23 is separated by contacting a bottom of the lip portion 11 during the spouting guide member 20 is ascended, thereby allowing the content to be dropt and mixed with a content in the container.

The ascending extent is limited by the fixing projection 24 formed on a lower-outer circumference of the spouting guide member 20.

The spouting guide member 20 is ascended and descended by the rotational operation of the cap 30. That is, in a state where the circumferential projection 22 formed on an upper-outer circumference of the spouting guide member 20 is coupled to the hook portion 31 formed on an inner surface of the cap 30, the spouting guide member 20 is ascended and descended together with the cap 30 by a predetermined distance. Before the cap 30 is separated from the main body 10, the circumferential projection 22 is separated from the hook portion 31. As a result, as shown in FIG. 3, the cap 30 is separated from the main body 10.

In a state where the cap 30 is separated from the main body 10, the spouting guide member 20 is projected upward so that the user can easily drink the content.

Since the air introducing portion 25 is formed on the spouting guide member 20, the air is injected in the container while drinking, thereby making it easy for the user to easily drink the mixed content.

The spout assembly 1 of this embodiment can be varied in a variety of structures. For example, the spout assembly 1 can be coupled to the neck portion of the container by a screw coupling or a one-touch coupling.

FIG. 4 shows a second embodiment of the present invention, in which a main body 10 is designed to be applicable to a pouch container. A spouting guide member 12 is formed on the main body 10 and a lip portion 11 of the main body 10 functions as a neck of the container by directly coupling the spouting guide member 20 to the pouch container.

A space portion 21 of the spouting guide member 20 can be varied in a variety of designs. For example, the lower portion of the space portion 21 may be widened or the lip portion 11 may be varied to be curved to a side by a folding portion.

In addition, the spouting guide member 20 may be designed to be projected upward so that it can be sealed on an upper portion of the container neck.

FIG. 5 shows a third embodiment of the present invention, in which a seal projection 231 is formed on a seal closer to seal a lower end of a space portion 21 so that content stored in the space portion 21 can be effectively directed into the container. A dropping space portion 232 is formed so that the content stored in the space portion 21 is dropt into the container during the lower end of a spouting guide member 20 is spaced away from the seal projection 231.

If required, another space S may be formed on a lower end of the lip portion 11 and an upper portion of the seal closer 230 so that the content can be stored in the space S, thereby storing the more amount of the content.

FIGS. 6 and 7 shows a fourth embodiment of the present invention. An extending portion 41 extending toward an inner-lower portion of the main body 10 is formed. A plurality of punching projections 42 are formed inside the extending portion 41. A side exhaust hole 43 communicating with the container is formed on a lower portion of the spouting guide member 20 coupled to an inside of the lip portion 11. A space portion 44 for storing a different material is formed between the spouting guide member 20 and the extending portion 41. A seal member is attached on the lower ends of the spouting guide member 20 and the extending portion 41.

Accordingly, when the cap 30 moved upward, the spouting guide member 20 moves upward, and as shown in FIG. 7, the seal member 45 is broken by the punching projections 42, thereby allowing the content stored in the space portion 44 is dropt into the container to mix with the content in the container. The mixed content is exhausted through the side exhaust hole 43.

FIG. 8 is a view of a fifth embodiment of the present invention. A movable spout 50 is inserted through a lower end of the spouting guide member 20 so that the content in the container can be exhausted through the movable spout 50 and the spouting guide member 20.

A character is coupled on a top of the cap 30.

FIG. 9 shows a sixth embodiment of the present invention. An air introducing hole 60 is formed on the spout guide portion 20 and an attaching portion 61 is formed on a lower portion of the spouting guide member 20. A seal member 62 is attached on the extending portion 41 and the attaching portion 61 to define a space portion 63 for storing the different material. When the spouting guide member 20 moves upward, the seal member 62 is broken so that the different material stored in the space portion 63 can be dropt into the container.

FIG. 10 shows a seventh embodiment of the present invention. A storing container 70 storing the different material is formed below the spouting guide member 20 and a seal member 71 is attached on a lower end of the extending portion 41. A plurality of projections 72 are formed in a longitudinal direction on an inner surface of the storing container 70 so that the material can be easily dropt by applying impact. When the spouting guide member 20 moves upward, the seal member 71 is separated, thereby allowing the material in the storing container 70 to be dropt in the container.

FIG. 11 shows an eighth embodiment of the present invention. An inner cap 80 is formed inside a cap 30. The inner cap 80 is provided with a screw portion 81, a screw-direction of which is opposite to that coupled on a main body 10. The screw portion 81 is screw-coupled to an upper-inner portion of a spouting guide member 20. A seal member 82 is attached on a lower end of an extending portion and a punching portion 83 is formed on a lower portion of the spouting guide member 20 to allow the material to be dropt in the container. When the cap 30 rotates, the cap 30 and the inner cap 80 moves upward. As a result, the spouting guide member 20 screw-coupled to the inner cap 80 moves downward to allow the punching portion 83 to break the seal member 82 so that the material can be dropt.

FIG. 12 shows a ninth embodiment of the present invention. An opening portion 90 is formed on an upper portion and a one-touch seal closer 91 is coupled on the opening portion 90. A dropping space 92 is formed on a side portion of the extending portion 41 and a seal member 93 is coupled or attached on a lower end of the spouting guide member 20. When the cap 30 moves upward, the seal closer 91 is opened upward and the spouting guide member 20 moves downward by the operation of the inner cap 80, thereby breaking the seal member to allow the material to be dropt.

FIG. 13 shows a tenth embodiment of the present invention. A main body 10 is coupled on an upper portion of a container 100 and an extending portion 101 is formed inside the main body 10, extending downward. An opening portion is formed on a side portion of the extending portion and a seal member 103 is formed on a lower end of the extending portion 101.

A movable member 105 provided with a storing portion 104 storing the different material is coupled on the upper portion of the main body 10. A cap 30 is coupled to the upper portion of the movable member 105.

A seal member 103 is inserted in a lower portion of the storing portion 104 and a spout member 106 is inserted in an upper portion of the movable member 105. An air introducing portion is formed on an outer surface of the spout member 106 in a longitudinal direction.

An outer hook step 104*a* is projected on an outer surface of the storing member 104. An inner hook step 10*a* on which the outer hook step 104*a* is hooked is formed on an inner surface of the main body 10.

In this embodiment, when the movable member 105 moves upward by a screwing operation, the storing portion 104 is separated from the seal member 103 inserted in a lower portion of the storing portion 104, thereby allowing the different material to be dropt in the opening portion 102. After this, when the cap 30 is separated from the movable member 105, the mixed material in the container is exhausted through the opening portion 102 and the spout member 106.

At this point, the upward movement of the movable member 105 is limited by the inner hook step 10*a* formed on the inner surface of the main body 10, which is hooked on the outer hook step 104*a* formed on the outer surface of the storing portion 104.

As a plurality of air introducing portions 107 are formed on the outer surface of the spout member 106 in the longitudinal direction, outer air is introduced into the container 100 when the mixed material is exhausted.

FIG. 14 shows an eleventh embodiment of the present invention. A main body 10 is provided at an upper portion with a lip portion 11 and at a lower portion with a space defining surface 110. An inner closer 112 111 is installed between the main body 10 and the space defining surface 110, thereby defining a space portion 111 for storing the different material.

A spouting guide member 20 is elevatably inserted in the lip portion 11. A seal member 114 is formed on a lower portion of the spouting guide member 20 to selectively seal the lower portion of the inner closer 112.

A cap 30 is coupled on an upper-outer portion of the lip portion 11 and a fixing portion 114 for fixing a character C is formed on an upper portion of the cap 30.

The spouting guide member 20 and the inner closer 112 are communicable by an introducing hole 113 to store the different material.

Accordingly, when the cap 30 moves upward, the spouting guide member 20 moves together, thereby opening a center of the inner closer by a seal portion 114 to allow the different material to be dropt into the container. In drinking, the mixed material introduced into the space portion 111 is directed to the spouting guide member 20 through the introducing hole 113.

FIGS. 15 and 16 show a twelfth embodiment of the present invention. This embodiment is similar to the eleventh embodiment except that an inner closer 120 is coupled inside the main body 10 together with the container, thereby providing seal.

The inner closer 120 extends downward to define a space portion 121 storing a different material. The inner closer 120 is provided at a center with a dropping portion 122 in which a packing 123 is inserted in the dropping portion 122 to allow a seal surface 124 formed on a lower portion of the spouting guide member 20 to tightly contact, thereby preventing the different material from being inadvertently dropt.

The spouting guide member 20 is provided at a lower portion with lo an introducing hole 125 allowing the mixed material to be easily exhausted out of the container.

The inner closer 120 includes an upper seal portion 126 contacting a neck portion of the container and a side seal portion 127 contacting an inner surface of the neck portion.

The spouting guide member 20 is provided at an outer surface with a hook step 128 being limited in its upward movement.

A cap 30 is coupled to an outer surface of the lip portion 11 of the main body 10 and the spouting guide member 20 inserted in the lip portion 11 moves upward together with the cap 30 by a predetermined distance.

The packing 123 is installed on the dropping portion 122 to tightly contact the seal surface 124. The packing 123 may be formed in a check valve type that is convex downward and inserted to be opened by pressure sucked through the spouting guide member 20 or by the pressure increase in the container. Alternatively, as shown in FIG. 16, the packing 123 may be formed in a T-shape so that it can be inserted and fixed in the seal surface 124. When the seal surface 124 extends downward and the packing 123 is installed on an outer portion of the seal surface 124 to tightly contact the upper portion of the dropping portion 122, thereby providing a perfect seal.

Accordingly, when the cap 30 moves by the screwing operation, the spouting guide member 20 moves upward, thereby the seal surface 124 is spaced away from the packing 123, thereby opening the dropping portion 122 to allow the different material to be dropt in the container. Accordingly, the content mixed with the different material in the container is exhausted through the spouting guide member 20 via the introducing hole 125 when using the content.

FIGS. 17 and 18 show a thirteen embodiment of the present invention. This embodiment is similar to the thirteen embodiment except that the different material is stored in the inner closer 120 and the spouting guide member 20.

The spouting guide member 20 is sealed at its lower portion and is provided with a communication hole 130 communicating with the inside of the inner closer 120. A seal portion 131 extending from the spouting guide member 20 is formed inside a dropping portion 122 formed on a lower portion of the inner closer 120. A packing 132 is installed on an outer surface of the seal portion 131, thereby making it possible to store and release the different material.

As shown in FIG. 18, the cap 30 is provided with an inner projection 133 closely contacting an upper-outer surface of the lip portion 11 of the main body 10.

Accordingly, the seal is realized by the packing 132 installed between the dropping portion 122 of the inner closer 120 and the seal portion 131 in a state where the different material is stored in the spouting guiding member 20 and the inner closer 120. By allowing the inner projection 133 formed on the cap 30 to tightly contact the upper-outer surface of the lip portion 11, the perfect seal is realized through the cap 30.

At this point, when the cap 30 coupled to the lip portion 11 of the main body 10 moves upward by a screwing operation, the spouting guide member 20 moves upward, and at the same time, the seal portion 131 and the packing 132 are separated from the dropping portion 122 of the inner closer 120. As a result, the different material in the spouting guide member 20 is exhausted into the inner closer 120 through the exhaust hole 13 and dropt into the container 100 through the dropping portion 122. The different material in the inner closer 120 is dropt through the dropping portion 122.

The mixed content in the container 100 is directed into the inner closer 120 through the dropping portion 122 and further directed to the spouting guide member 20 through the exhaust hole 130 so that the user drinks the content.

FIG. 19 shows a fourteen embodiment of the present invention. A cap 30 is screw-coupled to a lip portion 11 of the main body 10 attached on an exhaust portion of a pouch container 100. The spouting guide member 20 storing the different material is separately coupled in the cap 30. A seal member 141 having a dropping portion 140 is formed on a lower end of the spouting guide member 20. It is preferable that the seal member 141 is formed in a lower-inner side of the main body 10.

Accordingly, when the cap 30 moves upward by the screwing operation, the spouting guide member 20 is inserted in the seal member 141 to provide a seal.

FIG. 20 shows a fifteenth embodiment of the present invention. This embodiment is similar to the fourteen embodiment except that a plurality of guide steps 150 formed in a lower-inner portion of the main body 10. A seal member 151 attached on an opened lower end of the spouting guide member 20 is coupled on the guide steps 150.

Accordingly, when the spouting guide member 20 moves upward by the upward operation of the cap 30, the seal member 151 coupled on a lower portion of the spouting guide member 20 and supported by the guide steps 150 is separated and dropt. By this, the lower portion of the spouting guide member 20 is opened so that the different material can be dropt in the container 100.

FIGS. 21 and 22 show a sixteenth embodiment of the present invention. As shown in FIG. 21, a sealing plate 160 is horizontally attached on a lower end of the spouting guide member 20. The sealing plate 160 is provided with a hook portion 161 extending outward.

The a plurality of sealing plate removing portion 162 are formed on an inner-lower portion of the main body 10.

It is not limited that the sealing plate 160 is horizontally formed. For example, as shown in FIG. 22, it can be inclined in a direction.

Accordingly, when a cap 30 moves upward to move a spouting guide member 20 upward, the seal plate 160 is separated by the seal plate removing portion 162 to open an lower portion of the spouting guide member 20, thereby allowing the different material to be dropt in the container.

When the seal plate 160 is inclined, it can be more easily separated from the spouting guide member 20.

INDUSTRIAL APPLICABILITY

As described above, the present invention can be applied all kinds of container storing the liquid material. Particularly, a different material is stored in the container and mixed with the liquid material so that it can be easily used for a user.

The invention claimed is:

1. A structure for mixing different materials, comprising:

a main body having a lip portion with an upper opening portion, a threaded exterior surface and a circumferential projection, the main body coupled to an opening of a container containing a first material;

a spouting guide member movably inserted in the lip portion by a predetermined distance, the spouting guide member including a fixing projection configured to abut the lip portion and thereby limit movement of the spouting guide member in a direction out of the container, the spouting guide member providing a space for storing a different material therein which is to be mixed with the first material;

a cap ascending and descending together with the spouting guide member having a hook portion which is releasably coupled to the circumferential projection, the cap being threadably coupled to the main body by the threads on the lip portion; and a seal closer separately and removably formed on a lower end of the spouting guide member such that after being removed to allow the different material which was stored in the space to be mixed with the first material, the space provided by the spouting guide member functions as a passage through which the first material mixed with the different material will be exhausted out of the container;

wherein the cap is unscrewed from the upper opening portion, the spouting guide is moved outward and away from the container due to the coupling between the hook portion and the circumferential projection, and the cap is removed from the spouting guide portion by further movement of the cap away from the container thereby separating the hook portion from the circumferential projection.

2. The structure of claim 1, wherein the cap is provided at an inner portion with the hook portion and the spouting guide member is provided at an upper outer circumference with the circumferential projection hooked on the hook portion.

3. The structure of claim 1, wherein the spouting guide member is provided at a lower-outer portion is provided with a fixing projection for limiting the ascending amount.

4. The structure of claim 1, wherein the spouting guide member is provided at an outer portion with an air introducing portion.

* * * * *